United States Patent [19]

Takano

[11] 4,222,215

[45] Sep. 16, 1980

[54] SCREW-CAPPING DEVICE

[75] Inventor: Motoharu Takano, Machida, Japan

[73] Assignee: Kewpie Kabushiki Kaisha, Tokyo, Japan

[21] Appl. No.: 23,185

[22] Filed: Mar. 23, 1979

[30] Foreign Application Priority Data

Apr. 7, 1978 [JP] Japan ..... 53-40285
Jan. 19, 1979 [JP] Japan ..... 54-3925

[51] Int. Cl.[2] ..... B67B 3/20; B65B 7/28
[52] U.S. Cl. ..... 53/331.5
[58] Field of Search ..... 53/331.5, 348, 361, 53/329

[56] References Cited

U.S. PATENT DOCUMENTS

| | | | |
|---|---|---|---|
| 2,839,883 | 6/1958 | Roberts et al. | 53/348 |
| 3,031,822 | 5/1962 | Dimond | 53/331.5 X |
| 3,491,516 | 1/1970 | Bergeron | 53/331.5 X |
| 3,913,301 | 10/1975 | Keller et al. | 53/331.5 |
| 3,955,341 | 5/1976 | Wilhere | 53/331.5 |

FOREIGN PATENT DOCUMENTS

| | | | |
|---|---|---|---|
| 2436993 | 8/1975 | Fed. Rep. of Germany | 53/331.5 |
| 2361067 | 12/1975 | Fed. Rep. of Germany | 53/331.5 |

*Primary Examiner*—Horace M. Culver
*Attorney, Agent, or Firm*—Oblon, Fisher, Spivak, McClelland & Maier

[57] ABSTRACT

A device for screw-tightening caps on containers such as bottles has a cap chuck head for grasping and holding each cap with holding pawls, a driving shaft, and a friction clutch mechanism constructed separately from the chuck head but mechanically coupling the driving shaft and the chuck head to transmit rotational power to the chuck head at torques below a predetermined maximum torque, at which the cap is screw tightened, friction plates of the clutch mechanism slipping at any higher torque to prevent excessive tightening. The separate construction of the clutch mechanism and the chuck head prevents subsequent engagement of the clutch plates due to reaction forces arising during the screw-tightening operation, thereby preventing excessive tightening.

5 Claims, 10 Drawing Figures

SCREW-CAPPING DEVICE

BACKGROUND OF THE INVENTION

This invention relates generally to screw-capping devices for automatically screw-tightening caps on containers such as bottles. More particularly, the invention relates to a screw-capping device which the operational action of grasping and releasing each cap by means of cap holding pawls is accomplished by utilizing air pressure.

In the past, various cap tightening devices for automatically tightening caps on containers such as bottles have been developed. The devices most generally used are of a type wherein each of a large number of cap holding heads, which ascend, descend, and rotate, grasps and picks up one cap from among many caps which have been fed with their open sides down onto a turntable and screw-caps the cap onto the open part of a container which has arrived at a position immediately below that head.

Among cap tightening devices of this type there is one (as disclosed in the specification of Japanese Patent Application No. 138,679/1977) wherein there are provided a rotating shaft rotated by suitable driving means and a cap holding cylinder having a plurality of cap holding pawls pivotally supported around a circle and having tooth edges at the inner side of the circle, an elastic ring member being stretched around the outer surfaces of the cap holding pawls thereby to impart thereto a force tending to thrust their tooth edges inward to grasp and hold a cap. Between the shaft and the cap holding cylinder, there is interposed a friction clutch to transmit rotation therebetween under torques below a certian predetermined value. Furthermore, a pressing member capable of ascending and descending in an air-tight manner is inserted above the cap holding pawls, and a pressurized air chamber for introduction of pressurized air thereinto is formed between the upper surface of the pressing member and the inner wall surface of the cap holding cylinder. When the pressurized air is introduced into this chamber, the pressing member is forced downward, and its lower peripheral part presses against the upper ends of the cap holding pawls thereby to spread and open the pawls and to release the cap.

In this device, however, compressed air for forcing down the pressing member as mentioned above is sent from the lower part of a support stem for rotatably supporting the cap holding cylinder directly from above onto the upper surface of the pressing member, the upper part of which is in sliding contact with a cylinder. When, upon completion of the tightening of the cap, pressurized air is supplied to force the pressing member down, and the cap holding pawls are spread and opened, the above mentioned cylinder is instantaneously pressed downward by the forcing down of the pressing member. Furthermore, since the cap holding cylinder and the part enclosing the friction clutch part are assembled integrally within the same housing, a reaction force arising from the opening of the cap holding pawls acts instantaneously on the clutch side.

As a result, the friction plates of the clutch, which have been in a slipping state after completion of cap tightening, are again pressed together, and the cap holding cylinder is again rotated to additionally tighten the cap, whereby the cap is excessively tightened.

SUMMARY OF THE INVENTION

It is an object of this invention to provide a screw-capping device wherein excessive tightening of a cap on a container is prevented.

Another object of the invention is to provide a screw-capping device wherein excessive tightening of a cap on a container is prevented, and, moreover, the cap tightening torque can be adjusted while the device is being driven.

According to this invention in a general form thereof, briefly summarized, there is provided a screw-capping device comprising:

- a vertical, hollow rotating shaft driven by a suitable driving device;
- a support stem inserted axially through the rotating shaft and having an axial, first air passage for supplying pressurized air;
- a hollow coupling secured to the lower end of the support stem and having a second air passage communicating with the first air passage at the lower end thereof;
- a vertical central shaft slidably fitted at the upper end thereof in the hollow interior of the coupling and having an axial third air passage communicating at the upper end thereof with the second air passage, sealing means being provided to seal the sliding fit between the central shaft and the coupling against leakage of air therethrough;
- a clutch mechanism having driving and driven friction plates and interposed between the rotating shaft and the central shaft to transmit power therebetween at torques below a specific maximum torque, the clutch mechanism being enclosed within a clutch housing fixed to the rotating shaft; and
- a cap chuck head comprising a cap holding cylinder fixed at upper part thereof, in a state separated from the clutch housing, to the lower end of the central shaft and having a socket open at the bottom thereof, a plurality of cap holding pawls respectively having tooth edges at the inner periphery of the socket and pivotally supported by the cap holding cylinder in a circular arrangement, means for elastically urging the pawls to rotate in a direction to project the tooth edges thereof into the socket thereby to grasp and hold a cap in the socket, and a pressing member fitted in a slidable yet sealed manner in a deeply inner part of the socket and engaging at the lower part thereof with the upper ends of the tooth edges, a pressurized air chamber being formed between the cap holding cylinder and the pressing member and communicating with the lower end of the third air passage, the pressing member being forced downward against the tooth edges when pressurized air is supplied through the first, second, and third air passages into the air chamber thereby to spread open the tooth edges and release the cap which has been held thereby.

The nature, utility, and further features of this invention will be more clearly apparent from the following detailed description with respect to preferred embodiments of the invention when read in conjunction with the accompanying drawings, briefly described below.

DETAILED DESCRIPTION

Figure 1:
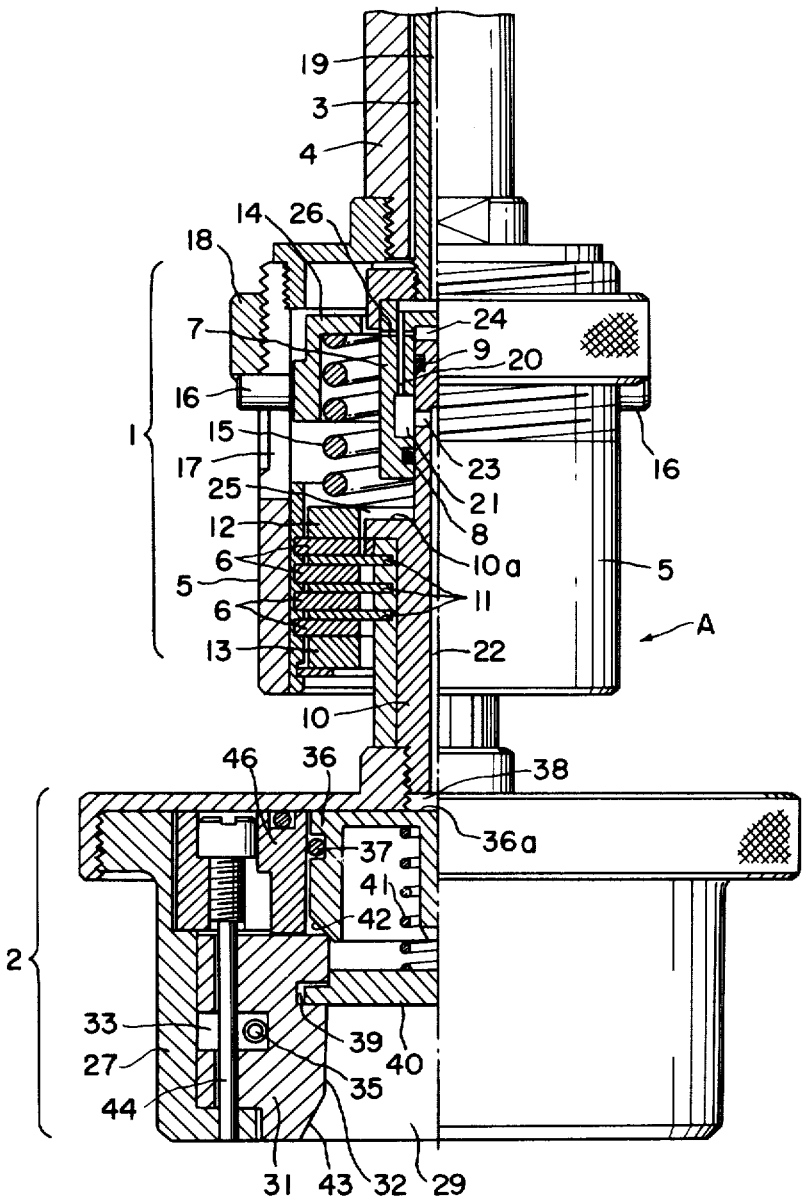
FIG. 1 is an elevation, with one half in vertical section, showing one example of the screw-capping device according to this invention.

As shown in FIG. 1 illustrating one embodiment of this invention, the screw-capping device A according to the invention, generally considered, is made up of two principal components, namely, a clutch mechanism 1 and a cap chuck head 2 disposed almost invariably below and coaxially with the clutch mechanism 1 and coupled thereto. The screw-capping device A is designed to be used in plural number in an automatic screw-capping machine as described hereinafter with reference to FIGS. 8 and 9.

The clutch mechanism 1 is suspendedly supported by a hollow, non-rotating support stem 3, which is vertically and stationarily supported, and around which is fitted a hollow rotating shaft 4 drivable by a driving device (not shown). A cylindrical housing 5 is mounted coaxially on the lower end of this rotating shaft 4 by means such as a screw connector. A plurality of driving friction plates 6, 6, . . . are spline-connected to the inner wall surface of the housing 5 and are thus slidable relative to the housing 5 in the axial direction thereof. A plurality of driven friction plates 11, 11, . . . are alternately interposed between the driving friction plates 6, 6, . . . and are spline-connected to the outer cylindrical surface of a central shaft 10, the upper and middle parts of which disposed coaxially in the housing 5, the friction plates 11, 11, . . . thereby being slidable relative to the central shaft 10 in the axial direction thereof. The central shaft 10 is fitted at its upper end in a hollow cylindrical coupling 7 fixed at its upper part to the lower end of the above mentioned support stem 3.

A pressure plate 12 and a counter-pressure plate 13 are disposed in contact respectively with the upper and lower surfaces of the group of driving and driven friction plates 6, 11. A compression coil spring 15 is interposed between the pressure plate 12 and a spring retainer 14 fitted within the housing 5. The spring retainer 14 is provided around its periphery with pins 16, 16, which extend radially outward through slots 17, 17 formed in the housing 5 in the axial direction thereof. These pins 16, 16 are pressed upward, by the force of the compression spring 15, against an adjusting nut 18 screwed onto a threaded upper part of the housing 5. Thus, the vertical position of the pins 16, 16, and therefore the force of the spring 15 exerted on the pressure plate 12, can be adjusted by turning this adjusting nut 18.

This force applied to the pressure plate 12, and therefore on the friction plate group 6, 11, determines the range of torque, i.e., the maximum torque, which can be transmitted by the clutch mechanism of the friction plate group 6, 11. When the torque applied to this clutch mechanism exceeds the maximum torque, the clutch mechanism slips, and torque is no longer transmitted through the clutch mechanism. Thus, this limiting maximum torque which can be transmitted, which is therefore the maximum torque ultimately applied to a screw-capped cap, can be adjustably set by means of the adjusting nut 18.

The aforementioned support stem 3 has through its center in the longitudinal direction an inlet passage 19 for pressurized air, which communicates at its lower end with the upper end of a longitudinal passage 20 formed in the upper cylindrical wall part of the aforementioned coupling 7 of the support stem 3. The inlet passage 19 at its upper end communicates with a source (not shown) of pressurized air. The lower end of the passage 20 opens into an annular groove 21 formed around inner wall surface of the coupling 7. This annular groove 21 communicates through at least one through hole 23 in an upper part of the aforementioned central shaft 10 with a central passage 22 for pressurized air bored through the central shaft 10 in the longitudinal direction thereof to an open end at the lower end of the central shaft 10.

At positions above and below the annular groove 21, O-rings 9 and 8 are provided between the coupling 7 and the central shaft 10 for sealing to prevent escape therebetween of prossurized air. Clearances 24 and 25 of necessary dimensions are provided respectively between the upper end face of the central shaft 10 and the inner ceiling surface of the top part of the coupling 7 and between the lower end of the coupling 7 and a peripheral ledge 10*a* of the central shaft 10. A vent hole 26 is formed through the cylindrical wall of the coupling 7 at its upper part to provide an escape passage for air in the space formed by the clearance 24. The clearances 24 and 25 are provided so that the cap chuck head 2 and the central shaft 10 can be pushed upward and yet afford smooth screw-capping operation even when a container being capped is somewhat taller than a specified container.

The cap chuck head 2 has a cap holding cylinder 27 constituting a housing and a support structure and secured to the lower of the central shaft 10 by screw connection or some other suitable connecting means. The cap holding cylinder 27 has a hollow interior, the lower portion of which constitutes a downwardly opening socket 29 defined by a cylindrical inner wall surface for loosely fitting onto a cap 28 to be screw-capped. The cap holding cylinder 27 is provided therearound with a plurality of evenly spaced apart cutout recesses 30, 30, . . . extending from its outer peripheral surface obliquely to respective openings in the inner wall surface of the socket 29 as shown in FIG. 3.

In these cutout recesses 30, 30, . . . , respective cap holding pawls 31, 31, . . . are pivotally supported by vertical pivot shafts 44. Since, as mentioned above, the cutout recesses 30, 30, . . . are formed in evenly spaced apart positions around the holding cylinder 27, stepped parts 45, 45, . . . are formed around the cylinder 27. Furthermore, the inner edges on the side of the socket 29 of these stepped parts 45, 45, . . . are formed to lie on a circle of a diameter slightly greater than the diameter of the cap 28 so as to facilitate the introduction of the cap 28 into the socket 29.

Figure 3:
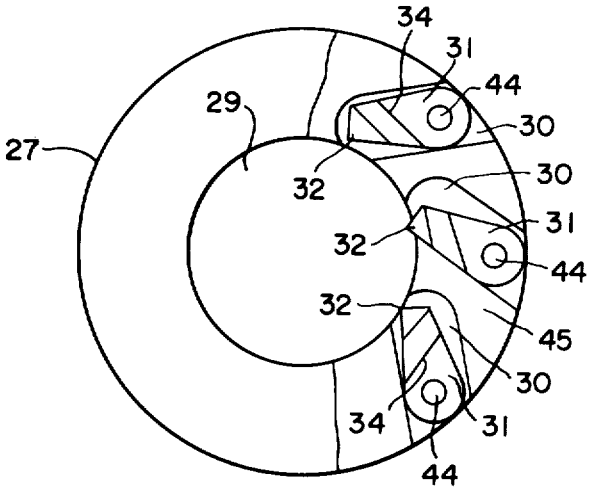
FIG. 3 is a bottom view, with parts deleted, of a cap holding cylinder constituting an essential part of the cap chuck head.
Figure 4:
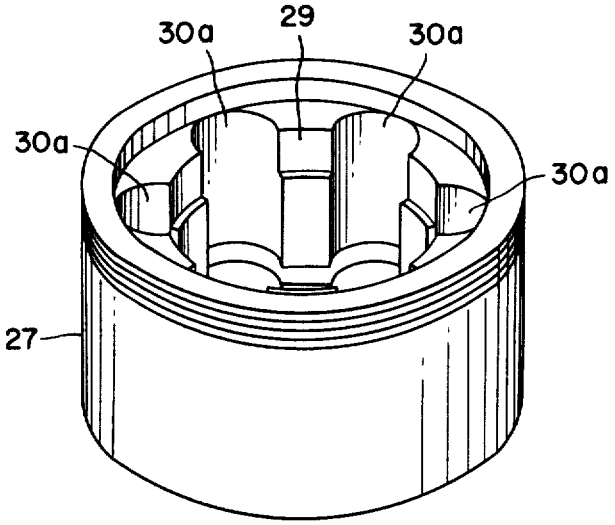
FIG. 4 is a perspective view of another example of a cap holding cylinder of the cap chuck head, shown without cap holding rolls.

Each of the cap holding pawls pivotally supported at their proximal outer ends on the pivot shafts 44 has at its inner end a tooth edge 32 which can be moved slightly into the socket 29 by swinging the pawl 31 counterclockwise as viewed in FIG. 3 until it contacts one side of the slot 30. A cutout recess 33 is formed in the proximal outer end of each pawl 31, extending horizontally into the pawl past the hole for receiving the pivot shaft 44 to a vertical contact surface 34. An elastic ring 35 such as a spring ring or a rubber ring is stretched around the contact surfaces 34, 34, . . . of all holding pawls 31, 31, . . . The shape and orientation of each contact surface 34 is so designed that when the elastic force of the elastic ring 35 is thus applied thereto, the pawl 31 is urged to pivot counterclockwise so that its tooth edge 32 is held in the state wherein it is projecting slightly into the socket 29 beyond the peripheral wall surface thereof.

In the deepest part of the socket 29 of the cap holding cylinder 27, a pressing piston 36 is slidably fitted in a cylinder 46, the fit therebetween being sealed by an O-ring 37. The upper surface 36*a* of this piston 36 constitutes a pressure receiving surface which is at the bottom of a pressurized air chamber 38 formed between this surface 36*a* and the bottom end face of the central shaft 10. A coil compression spring 41 for return force is interposed between the inner surface of the piston head of the pressing piston 36 and the upper end of a disk 40 for pressing the top of a cap 28. The peripheral edge of this disk 40 is engaged with cutout notches 39, 39, . . . formed in the tooth edges 32, 32, . . . of all holding pawls 31, 31, . . .

The pressing piston 36 has, around the outer periphery of its lower skirt end, a frustoconically beveled face 42, which can engage the upper edge ends of the tooth edges 32, 32, . . . The cap holding pawls 31, 31, . . . are provided at their lower ends of its tooth edge 32 with a beveled face 43 for facilitating the spreading and opening of the cap holding pawls 31 when the lower ends of the tooth edges 32 abut against the upper peripheral edge of a cap 28.

The cap holding members are not limited to the cap holding pawls 31, 31, . . . in the above described example. It is also possible use other means such as rolls of semicircular cross section having projecting edges on one side, for example, as disclosed in Japanese Patent Publication No. 17911/1975.

More specifically, as shown in FIGS. 4 through 7, the cap holding cylinder 27 is provided near its socket 29 with a necessary number of cutout recesses 30*a*, 30*a*, . . . defined by partially cylindrical inner wall surfaces with parallel centerlines which are parallel to and equidistant from the centerline axis of the cap holding cylinder 27 and are spaced at equal angular intervals thereabout. These recesses 30*a*, 30*a*, . . . open into and communicate with the socket 29. These recesses 30*a*, 30*a*, . . . rotatably accommodate respective cap holding rolls 31*a*, 31*a*, . . . of partially cylindrical shape. Each holding roll 31*a*, at its part facing inward into the socket 29, has a concave surface 50 of arcuate cross section as viewed in plane view which substantially coincides with inner wall surface of the socket 29. These holding rolls 31*a*, 31*a*, . . . function as cap holding members.

The cap holding rolls 31*a*, 31*a*, . . . are respectively provided with cutout grooves 33*a*, 33*a*, . . . formed at positions of the same height level on the outer side thereof or away from the socket 29. An elastic ring 35 such as a spring ring or a rubber ring similar to that in the preceding example is stretched around the holding rolls 31*a*, 31*a*, . . . and fitted in all of the grooves 33*a*, 33*a*, . . . to contact the minimum radius parts thereof. The shape and the position of the groove 33*a* are so selected that, when the elastic ring 35 is thus placed therein, the projecting edge 32*a* of the roll 31*a* on one side of the surface 50 is projected into the socket 29 beyond the cylindrical surface thereof, the imaginary cylinder in which these edges 32*a*, 32*a*, lie being of a diameter less than the outer diameter of the cap to be screw-capped. In addition, the holding rolls 31*a*, 31*a*, . . . are respectively provided with cutouts 39*a* at same height positions, whereby horizontal ledges 39*b* are formed. The peripheral edge of the disk 40 rests on these ledges 39*b*. In FIGS. 4 through 7, those other parts which are the same as or equivalent to corresponding parts in FIG. 1 are designated by like reference numerals and are not described in detail again.

The operations of the examples of the screw-capping device of the above described construction according to this invention will now be described.

In the operational step of chucking a cap 28, the cap 28 is conveyed to a position immediately below the cap chuck head 2, whereupon the cap chuck head 2 is lowered or the cap 28 side is raised to cause the two to approach each other. The inner rim edges of the stepped parts 45, 45, . . . then function to introduce the cap 28 into the socket 29 of the cap holding cylinder 27. The upper outer edge of the cap 28 thereupon abuts against the beveled faces of the lower ends of the tooth edges 32, 32, . . . of the holding pawls 31, 31, . . . within the cap holding cylinder 27, and the holding pawls 31, 31, . . . are forced outward by the entrance of the cap 28, rotating in the clockwise direction as viewed in FIG. 3 about respective pivot shafts 44, 44 . . . At the same time, the imaginary cylinder passing through all tooth edges 32, 32, . . . is enlarged and receives the cap 28. At this time, as a result of the rotational displacement of the contact surfaces of the cap holding pawls 31, 31, . . . , the elastic ring 35 is expanded and exerts a force on each holding pawl 31 in the returning direction thereof, that is, the direction which causes the tooth edge 32 to project into the socket 29.

As a result of the above described action, the tooth edges 32, 32, . . . of the cap holding pawls 31, 31, . . . engage the knurled outer peripheral surface of cap 28, whereby relative rotation therebetween is prevented. Then, the rotating shaft 4 is driven in the screw-capping direction (clockwise as viewed from above) by driving means (not shown), whereupon the cap 28 is screwed onto the upper open end of a container. The maximum screw-tightening torque in this operation is determined by the state of friction of the friction plates 6, 6, . . . and 11, 11, . . . of the clutch mechanism 1 as described hereinbefore. This rotational tightening action of the screw-capping device A continues until this maximum screw-tightening torque is reached, at which torque, slippage occurs between the friction plates 6 and 11, and the cap chuck head 2 stops rotating while the driving side of the clutch mechanism 1 freewheels. Therefore, the cap 28 and succeeding caps are screw-tightening with constant torque, and excessive tightening is prevented.

Upon completion of this screw-capping operation, pressurized air is supplied from a pressurized air supply source (not shown) through the inlet passage 19 of the support stem 3 and, passing through the passage 20 of the coupling 7 of the support stem 3, the annular groove 21, and the through hole 23, enters the passage 22 of the central shaft 10 and then the pressurized air chamber 38 to exert pressure on the pressure receiving surface 36*a* of the pressing piston 36, which thereupon is pushed downward. As a consequence of this descent of the piston 36, the beveled face 42 at its lower periphery pushes the upper ends of the tooth edges 32, thereby forcing the same to retract and release the cap 28 from their holding state.

The cap chuck head 2 and the container are mutually separated relatively in the vertical direction, whereupon the cap 28 screwed onto the container is extracted from the socket 29 of the cap holding cylinder. Further, the supplying of pressurized air is stopped, and the pressurized air in the cap chuck head 2 is released, whereupon the pressing piston 36 is raised and thus returned by the return spring 41.

Figure 7:
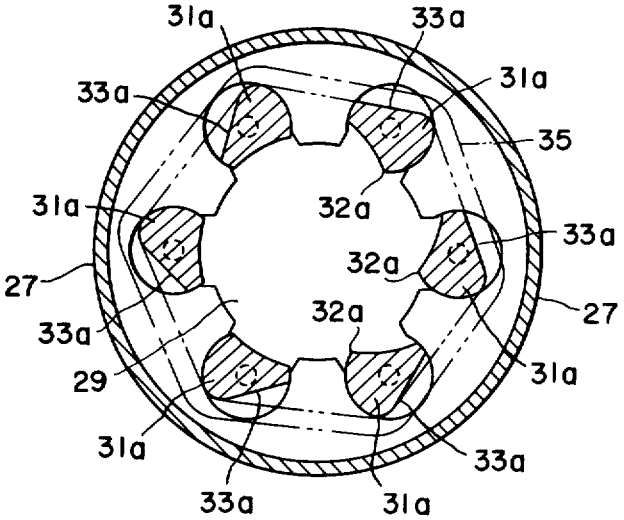
FIG. 7 is a section taken along the plane indicated by line VII—VII, as viewed in the arrow direction.

In the example of the cap chuck head illustrated in FIGS. 4 through 7, the edges 32*a*, 32*a*, . . . of the holding rolls 31*a*, 31*a*, . . . emerge from their retracted state shown in the left half of FIG. 7 and assume their projected state shown in the right half of the same figure thereby to grasp a cap and carry out their holding screw-tightening function.

Returning again to the first example of the screw-capping device of this invention, the path of the pressurized air is bent in the part from the inlet passage 19 into the coupling 7 and is bent again in the part of the annular groove 21, through hole 23, and the upper end of the passage 22 of the central shaft 10. For this reason, at the time when the pressurized air is supplied to move the pressing piston 36 downward in the above described operation, there is no action of pushing the central shaft 10 downward, and it is possible to push downward instantaneously only the pushing piston 36. Furthermore, since the cap holding cylinder 27 and the housing 5 of the clutch mechanism 1 are in a mutually separated state, reaction forces due to this operation are not transmitted directly to the clutch mechanism 1. Therefore, reengagement of the clutch does not occur at the time when the pressurized air is supplied, whereby there is no retightening of the cap 28.

That is, at the time when the cap holding pawls 31, 31, . . . release the cap 28 after the cap screw-tightening step, the clutch is not reengaged. Accordingly, excessive tightening of the cap is prevented, and control of the screw-capping device by compressed air becomes possible, whereby a problem accompanying known devices is effectively overcome.

Figure 10:
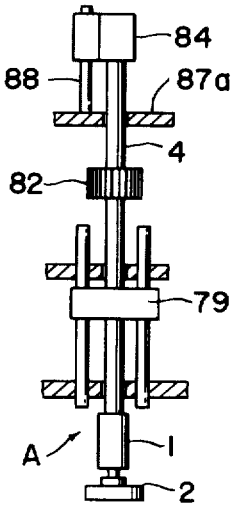
FIG. 10 is a schematic illustration of the embodiment shown in FIG. 8.
Figure 5:
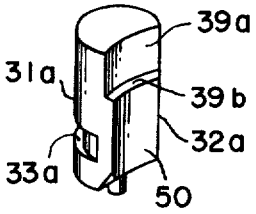
FIG. 5 is a perspective view of one cap holding roll to constitute a cap holding pawl in the cap holding cylinder shown in FIG. 4.
Figure 6:
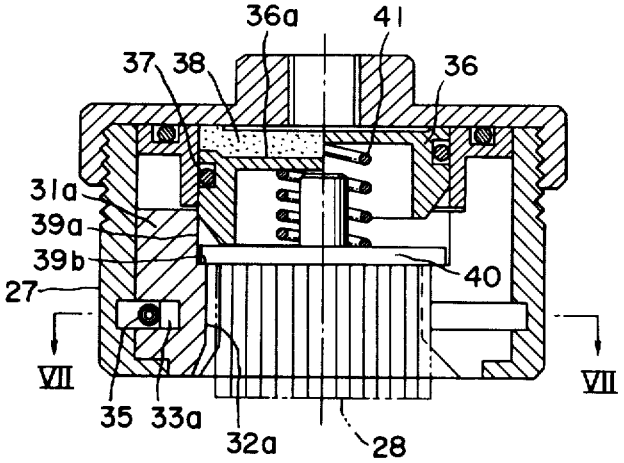
FIG. 6 is an elevation corresponding to FIG. 2, showing the cap chuck head with the cap holding cylinder shown in FIG. 4 provided with cap holding rolls each as illustrated in FIG. 5.

Another embodiment of this invention with now be described with reference to FIGS. 8, 9, and 10, in which those parts which are the same as or equivalent to corresponding parts in FIGS. 1 through 7 are designated by like reference numerals.

Figure 8:
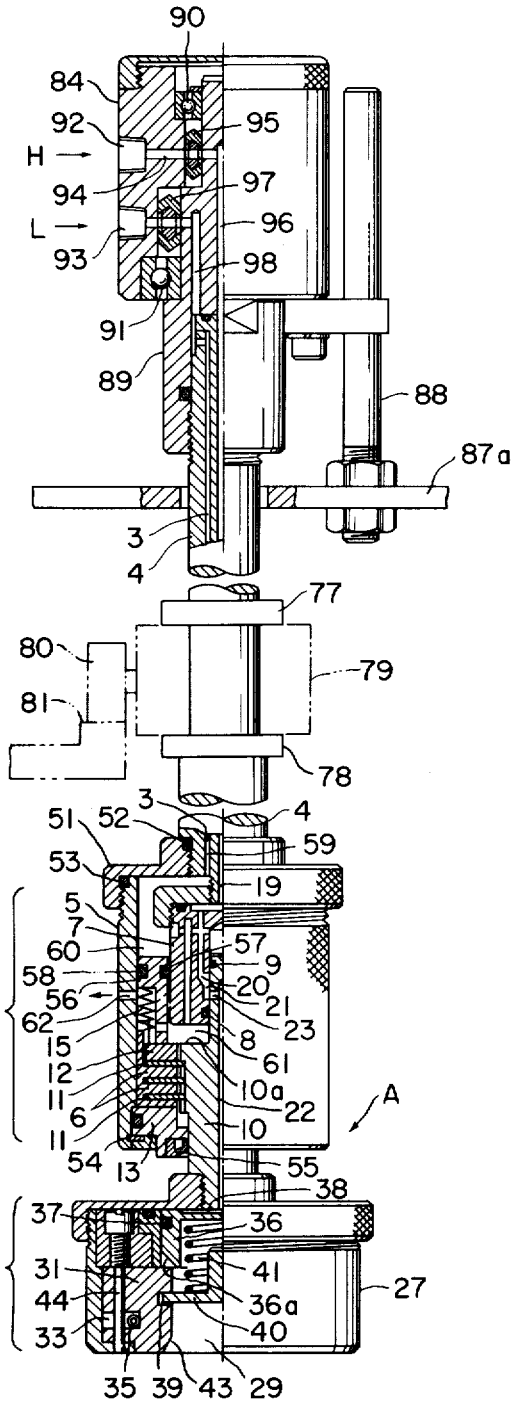
FIG. 8 is a foreshortened elevation, with parts shown in vertical section, showing an example of the screw-capping device constituting another embodiment of the invention.

In the specific example of the screw-capping device A of this invention shown in FIG. 8, the clutch mechanism 1 has a housing 5 secured by screw-thread connections, for example, by a cap nut 51 to the lower end of a vertical hollow rotating shaft 4 disposed around a hollow support stem 3, packings 52 and 53 being used as shown between these parts to seal the connections. Within and on this housing 5 are mounted by spline connection a plurality of annular friction plates 6, 6, . . . for driving.

Driven friction plates 11, 11, . . . mounted by spline connection on a vertical central shaft 10 are alternately interposed between the driving friction plates 6, 6, . . . . This group of friction plates 6, 6, . . . and 11, 11, . . . are interposed between upper and lower pressure plates 12 and 13, oil being sealed therebetween. The lower pressure plate 13 is locked to the housing 5 by a ring connector 54 and is shaft sealed relative to the central shaft 10 by an oil seal ring 55.

The upper end of the central shaft 10 is slidably inserted into a cylindrical coupling 7 secured by screw-thread connections or the like to the lower end of the support stem 3, packings 8 and 9 for sealing being interposed between the central shaft 10 and the coupling 7.

A pressing piston 56 is slidably interposed between the housing 5 and the coupling 7, and packings 57 and 58 for sealing are interposed as shown between these parts. A compression coil spring 15 is interposed between this pressing piston 56 and the above mentioned pressure plate 12 of the clutch.

The lower end of an air passage 59 formed in the above mentioned rotating shaft 4 communicates with a pressure chamber 60 the bottom of which is defined by the upper surface of the pressing piston 56. The lower end of an air passage 19 formed centrally through the support stem 3 communicates through an air passage 20 formed in the coupling 7 with an annular groove 21 formed around the inner wall surface of the coupling 7. A through hole 23 wich communicates with an air passage 22 formed centrally in the central shaft 10 has an opening at the outer peripheral surface of the central shaft faces and registers with the annular groove 20, being in a communicative state therewith throughout the range of ascending and descending movement of the central shaft 10.

In order to obtain good engagement at the beginning of meshing of the female and male screw threads of the cap 28 and the container (not shown in FIG. 8) at the start of the screw capping operation, a chamber 61 formed between the lower surface of the coupling 7, a peripheral ledge 10*a* of the central shaft 10 and the upper surface of the pressure plate 11 is made communicative with the outside atmosphere through a hole 62 formed through the side wall of the housing 5. Thus, if the cap 28 is pressed downward with an abnormally great force on the threaded part of the container, the cap holding cylinder 27 and the central shaft 10 within the screw-capping device A are pushed upward through a certain distance.

Figure 2:
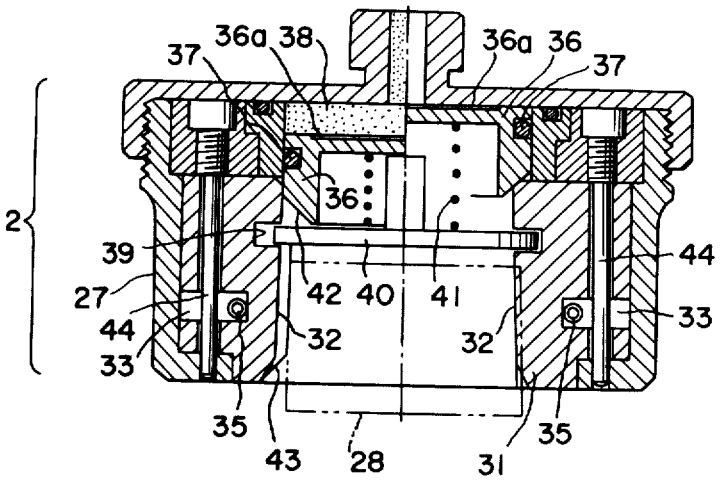
FIG. 2 is an elevation, in vertical section, of an example of a cap chuck head, in which the right-hand half shows the state of screw-tightening of a cap, while the left-hand half shows the state wherein, after completion of the screw-tightening, pressurized air is introduced to release the cap from its held state.

The construction and operation of the cap chuck head 2 of the instant embodiment of the invention are the same as those of the preceding embodiment of the invention described hereinbefore with reference to FIGS. 1, 2, and 3 and, therefore, will not be described again. In the instant example, also, the rolls 31*a*, 31*a*, . . . of semicircular cross section shown in FIGS. 4 through 7 can be used instead of the holding pawls 31, 31, . . . .

Figure 9:
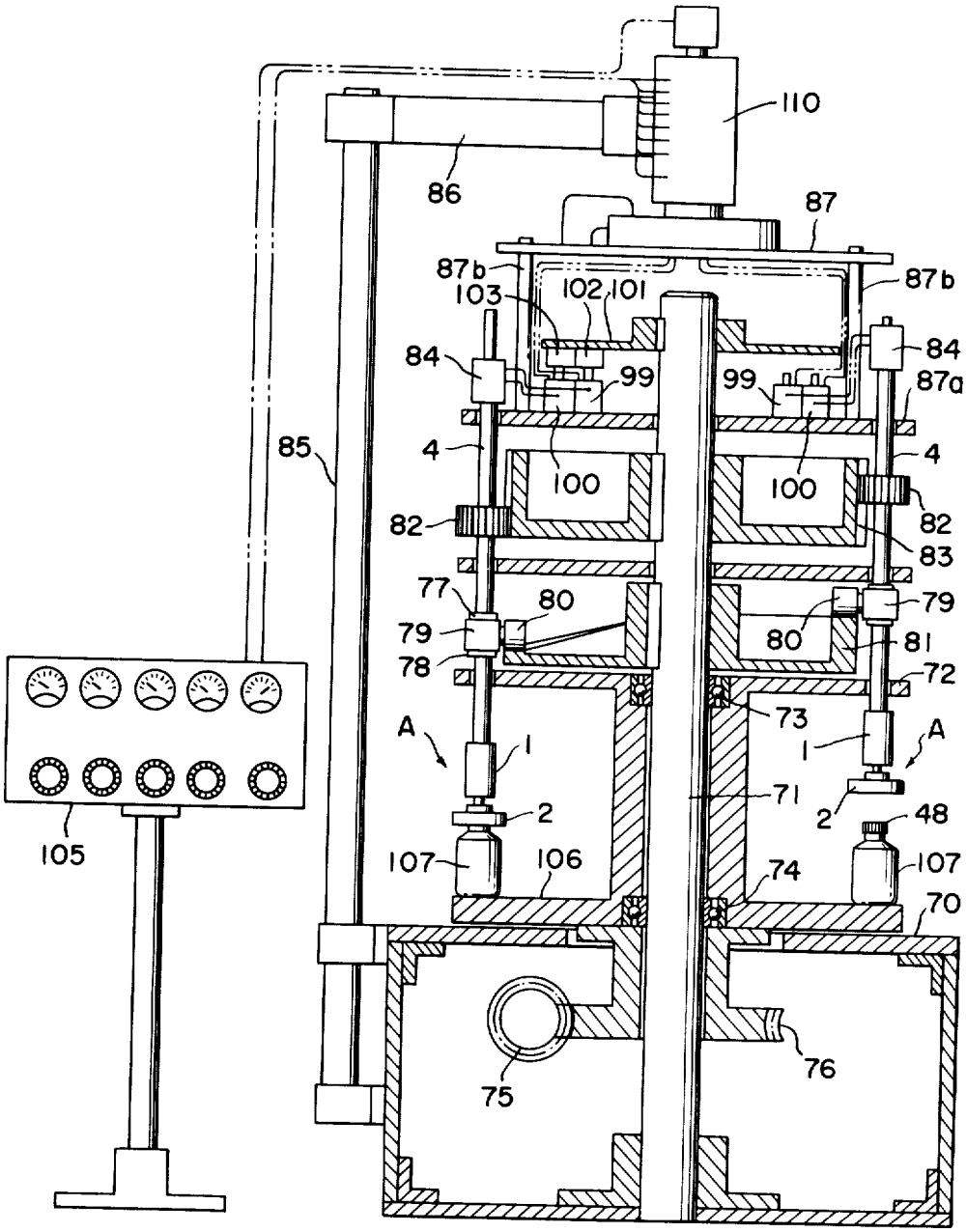
FIG. 9 is an elevation, with parts in vertical section, showing an example of an automatic screw-capping machine provided with screw-capping devices, each of which is as illustrated in FIG. 8, and which are arranged in a circle around a central main column to revolve thereabout.

Next, the pressurized air supply system will be described in conjunction with the example of a screw-capping machine of an essential construction as shown in FIG. 9.

The screw-capping machine has a base structure 70 supporting at the central part thereof a main column 71 extending vertically upward from the base structure 70. Around and on the main column 71, a rotary base frame 72 is rotatably supported by bearings 73 and 74 interposed therebetween. This rotary base frame 72 is driven in rotation by mechanical power transmitted from a motor (not shown) through a worm 75 and a worm wheel 76 fixed coaxially to the rotary base frame 72.

Around the outer peripheral part of the rotary base frame 72, a plurality of the aforedescribed screw-capping devices A are mounted with constant angular spacing in a common circle. The rotating shaft 4 of each of these screw-capping devices A is provided at an intermediate part thereof with two flanges 77 and 78 fixed thereto and a support block 79 rotatably fitted around the shaft 4 between the flanges 77 and 78. Each support block 79 is provided on its inner side with a cam roller 80, which is rotatable about a horizontal axis and is rollably engaged with the upper cam surface of a ring cam 81 fixed coaxially to the main column 71. Thus, as the rotary base frame 72 and the screw-capping devices A revolve around the main column 71, each of the cam rollers 80 follows the cam surface of the ring cam and is thus moved up or down, whereby the shaft 4 is moved up or down as described hereinafter.

A spur gear 82 is fixed to each shaft 4 and is meshed in an axially slidable manner with a large spur gear 82 having a large width of face or long tooth length in the axial direction and fixed coaxially to the main column 71. Thus, as the rotary base frame 72 revolves about the main column 71, each shaft 4 is rotated about its own axis.

A cap structure 84 is provided at the upper end of each rotating shaft 4. This cap structure 84 is prevented from rotating by a locking member 88 fixedly mounted on a suspended platform 87*a* as shown in FIG. 8. The cap structure 84 is rotatably connected through bearings 90 and 91 to an upper end member 89 fixedly secured to the upper end of the corresponding shaft 4. The above mentioned suspended platform 87*a* is rigidly suspended by suspension columns 87*b* from a suspension plate 87 fixed to the lower end of a branch pipe device 110, which is supported at the outer end of a cantilever arm 86. The inner or root end of the cantilever arm 86 is fixedly supported on the upper end of an upright support column 85, which is rigidly fixed at its lower end to a part of the base structure 70.

The above mentioned cap structure 84 is provided at its one side with a high-pressure air inlet 92 and a low-pressure air inlet 93 communicating with a pressurized air supply source (not shown). The inner end of the high-pressure air inlet 92 communicates with the outer end of a horizontal passage 94 communicating at its inner end in an airtight manner through a Vee packing 95 with the upper end of a vertical passage 96 formed centrally in the above mentioned upper end member 89 and communicating at its lower end with the upper end to the upper end of the aforementioned inlet passage 19 formed in the support stem 3. The inner end of the low-pressure air inlet 93 communicates in an airtight manner via a Vee packing 97 with the upper end of a vertical passage 98 formed in the upper end member 89 and communicating at its lower end to the aforementioned air passage 59 formed in the shaft 4.

A suitable high-pressure air H to be supplied into the high-pressure air inlet 92 is compressed air of a pressure of 4 to 5 $kg/cm_2$ G, which a suitable low-pressure air L to be supplied into the low-pressure air inlet 93 is compressed air of a pressure of 0.5 to 2 $kg/cm_2$ G.

The high-pressure and low-pressure air inlets 92 and 93 are supplied with the compressed air fed respectively through valve devices 99 and 100, which control the supply of the compressed air to the air inlets 92 and 93 and are mounted on the suspended platform 87*a* respectively in correspondence to each screw-capping device A as shown in FIG. 9. These valve devices 99 and 100 are actuated in their valve opening and closing operation respectively by cams 102 and 103 fixed to the lower surface of a mounting plate 101 which is fixed to the upper part of the aforementioned main column 71.

The distribution of the pressurized air to all screw-capping devices A is carried out by the above mentioned branch pipe device 110 to the lower part of which the suspension plate 87 is secured. This branch pipe device 110 is so constructed and adapted that the high-pressure air and low-pressure air sent from a pressurized air source (not shown) via a pressure adjusting valves of a control panel 105 are passed through internal passages formed to correspond to respective screw-capping devices thereby to supply the pressurized air at respective screw-capping positions.

The aforementioned rotary base frame 72 is in a substantially integral state relative to a turntable 106, onto which containers 107 to be capped and caps 48 are suitably fed by feeding means (not shown).

The example of the screw-capping machine of the above described essential construction operates in the following manner.

Referring to FIG. 9, containers 107 bearing respective caps 48 are successively fed onto the turntable 106 as mentioned above. When each container 107 reaches the screw-capping position, the cam roller 80 of the support block 79 of the corresponding screw-capping device A moves progressively from a high part to a low part of the cam ring 81, and the screw-capping device A accordingly descends.

As a consequence, similarly as in the aforedescribed embodiment of the invention, the cap 48 enters into the socket 29 of the cap holding cylinder 27 of the cap chuck head. The cap 48 is thereby guided into the cap holding cylinder 27 by the inner circular edges of the stepped parts 45, 45, . . . thereof. When the cap 48 contacts beveled faces 43, 43, . . . of the lower end of the tooth edges 32, 32, . . . of the cap holding pawls 31, 31, . . . , the holding pawls 31, 31, . . . are pressed outward by the entrance of the cap 48 and rotate clockwise, as viewed in FIG. 3, about their pivot shafts 44. As a consequence, the circle formed by the tips of the tooth edges 32, 32, . . . is widened thereby to receive the cap 48. At this time, the elastic ring 35 is expanded by the rotational displacements of the contact surfaces 34, 34, . . . of the cap holding pawls 31, 31, . . . and imparts to each of the cap holding pawls 31, 31, . . . a returning force (that is, a force in the direction in which the tooth edge 32 of that pawl 31 projects inward into the socket 29.

The above described series of actions causes the tooth edges 32, 32, . . . of the cap holding pawls 31, 31, . . . to engage and grasp the knurled outer peripheral surface of the cap 48 with sufficient tightness to prevent rotational slippage relative to each other. Then, the rotation of the corresponding gear 82 rotating around the large gear 83 in concert with revolving of the turntable 106 causes the shaft 4 to rotate in the screw-capping direction thereby to rotate the cap 48 in its screw-capping direction (clockwise as viewed from above).

The screw tightening torque in this operation is determined by the friction between the friction plates 6 and 11 of clutch mechanism 1, and the screw-capping is accomplished by a constant torque. After this screw tightening, free-wheeling occurs as a result of slipping between the friction plates 6 and 11, whereby excessive tightening is prevented. The setting of this constant tightening torque is accomplished by manipulatively adjusting the pressure adjusting valves of the control panel 105 provided outside of the automatic screw-capping machine thereby to control the pressure of the low-pressure air introduced into the pressure chamber 60 within the clutch mechanism 1. This low-pressure air is thus introduced through the valve device 100 opened by cam 103 and through the air passage 59 of the shaft 4.

Upon completion of the screw-capping in the above described manner, the valve device 99 is opened by the cam 102, and high-pressure air is supplied through the high-pressure air inlet 92, the passages 94, 96, 19, and 20, the annular groove 21, the through hole 23, and the passage 22 of the central shaft 10 and into the pressurized air chamber 38 thereby to exert pressure on the upper surface of the pressing piston 36, which thereby is pressed downward.

When the pressing piston 36 is thus forced downward, its beveled face 42 around its lower end presses against the upper ends of the tooth edges 32, 32, . . . of the cap holding pawls 31, 31, . . . , whereby the tooth edges 32, 32, . . . retract outward and release the cap 48.

When the operation reaches this stage, the cam roller 80 of the support block 79 rolls to a high part of the cam 81, whereby the entire screw-capping device A is lifted, and the cap holding cylinder 27 is lifted off and separated from the cap 48 in capped state on the container 107. At the same time, the cam 102 actuates and switches the valve device 99 corresponding to the above described screw-capping device A, whereupon the high-pressure air supplied into the screw-capping device A as described above its discharged out through the valve device 99. Consequently, the pressing piston 36 is returned upward by the force of the compression spring 41.

In this embodiment of the invention which carries out the above described operation, also, when high-pressure air is introduced into each screw-capping device to press the pressing piston 36 downward, the high-pressure air passes through the air passage 19 of the support stem 3, by passes the air passage 20 of the coupling 7 when the high-pressure air acts on the central shaft 10, and passes through the annular groove 21 and the through hole 23, thus flowing through a path with many bends. For this reason, there is no force directly pressing the central shaft in the axial direction, and, as a result, only the pressing piston 36 can be instantaneously pressed down.

Furthermore, since the cap chuck head 2 and the clutch mechanism 1 are separated, there is no reaction force transmitted directly to the clutch mechanism 1. Therefore, re-engagement of the clutch at the time of supplying of the pressurized air does not occur, and screwing on of the cap with excessive screw-tightening torque is prevented. Particularly in accordance with this embodiment of the invention, the supplying of the pressurized air is carried out entirely within the rotating shaft 4 of each screw-capping device A. For this reason, there is no necessity of installing a separate piping system, and when the screw-capping device of this invention is applied to a screw-capping machine as illustrated in FIG. 9, the construction thereof can be simplified.

Moreover, since the pressing force on the friction plates 6 and 11 of each clutch mechanism 1 is controlled by low-pressure air, this pressing force can be varied by controlling from the outside the pressure of this low-pressure air. Therefore, fine adjustment of the cap screw-tightening action can be carried out with the device maintained in its driven state.

Thus, this invention provides a screw-capping device which accomplishes automatic screw-capping of containers in a positive manner with a specific constant tightening torque without the possibility of screw-tightening with excessive torque.

I claim:

1. A screw-capping device comprising:

a vertical, hollow rotating shaft driven by a suitable driving device;

a support stem inserted axially through the rotating shaft and having an axial, first air passage for supplying pressurized air;

a hollow coupling secured to the lower end of the support stem and having a second air passage communicating with the first air passage at the lower end thereof, the air flow path from the first air passage through the second air passage being formed with bends;

a vertical central shaft slidably fitted at the upper end thereof in the hollow interior of the coupling and having an axial, third air passage communicating at the upper end thereof with the second air passage, sealing means being provided to seal the sliding fit between the central shaft and the coupling against leakage of air therethrough;

a clutch mechanism having driving and driven friction plates and interposed between the rotating shaft and the central shaft to transmit power therebetween at torques below a specific maximum torque, the clutch mechanism being enclosed within a clutch housing fixed to the rotating shaft; and a cap chuck head comprising a cap holding cylinder fixed at the upper part thereof, in a state separated from the clutch housing, to the lower end of the central shaft and having a cap-receiving socket open at the bottom thereof, a plurality of cap holding pawls respectively having tooth edges at the periphery of the socket and pivotally supported by the cap holding cylinder in a circular arrangement, means for elastically urging the pawls to rotate in a direction to project the tooth edges thereof into the socket thereby to grasp and hold a cap in the socket, and a pressing member fitted in a slidable yet sealed manner in a deeply inner part of the socket and engaging at the lower part thereof with the upper ends of the tooth edges, a pressurized air chamber being formed between the cap holding cylinder and the pressing member and communicating with the lower end of the third air passage, the pressing member being forced downward against the tooth edges when pressurized air is supplied through the first, second, and third air passages into the air chamber thereby to spread open the tooth edges and release the cap which has been held thereby.

2. A screw-capping device comprising:

a vertical, hollow rotating shaft driven by a suitable driving device;

a support stem inserted axially through the rotating shaft and having an axial, first air passage for supplying pressurized air;

a hollow coupling secured to the lower end of the support stem and having a second air passage communicating with the first air passage at the lower end thereof, the air flow path from the first air passage through the second air passage being formed with bends;

a vertical central shaft slidably fitted at the upper end thereof in the hollow interior of the coupling and having an axial, third air passage communicating at the upper end thereof with the second air passage, sealing means being provided to seal the sliding fit between the central shaft and the coupling against leakage of air therethrough;

a clutch mechanism having driving and driven friction plates and interposed between the rotating shaft and the central shaft to transmit power therebetween at torques below a specific maximum torque, the clutch mechanism being enclosed within a clutch housing fixed to the rotating shaft; and a cap chuck head comprising a cap holding cylinder fixed at the upper part thereof, in a state separated from the clutch housing, to the lower end of the central shaft and having a socket open at the bottom thereof, a plurality of cap holding pawls respectively having tooth edges at the periphery of the socket and pivotally supported by the cap holding cylinder in a circular arrangement, means for elastically urging the pawls to rotate in a direction to project the tooth edges thereof into the socket thereby to grasp and hold a cap in the socket, and a pressing member fitted in a slidable yet sealed manner in a deeply inner part of the socket and engaging at the lower part thereof with the upper ends of the tooth edges, a pressurized air chamber being formed between the cap holding cylinder and the pressing member and communicating with the lower end of the third air passage, the pressing member being forced downward against the tooth edges when pressurized air is supplied through the first, second, and third air passages into the air chamber thereby to spread open the tooth edges and release the cap which has been held thereby, the second air passage including an annular groove formed around the inner wall surface of the coupling and communicating with the upper end of the third air passage via a through hole formed transversely through the upper end of the central shaft.

3. A screw-capping device comprising:

a vertical, hollow rotating shaft driven by a suitable driving device;

a support stem inserted axially through the rotating shaft with space left therebetween to form a fourth air passage and having a separate, axial, first air passage;

a hollow coupling secured to the lower end of the support stem and having a second air passage communicating with the lower end of the first air passage;

a vertical central shaft slidably fitted at the upper end thereof in the hollow interior of the coupling and having an axial, third air passage communicating at the upper end thereof with the second air passage, sealing means being provided between the central shaft and the coupling;

a clutch mechanism comprising a clutch housing fixed to the lower end of the rotating shaft and enclosing the clutch mechanism, friction plates interposed between the central shaft and the clutch housing, and a first pressing piston forming, together with the inner wall surface of the clutch housing, a low-pressure air chamber and operating in response to the air pressure in the chamber to vary the pressing force on the friction plates thereby to vary the maximum clutch slipping torque; and a cap chuck head comprising a cap holding cylinder fixed at the upper part thereof, in a state separated from the clutch housing, to the lower end of the central shaft and having a cap-receiving socket open at the bottom thereof, a plurality of cap holding pawls respectively having tooth edges at the periphery of the socket and pivotally supported on the cap holding cylinder in a circular arrangement, means for elastically urging the pawls to rotate in a direction to project the tooth edges thereof into the socket thereby to grasp and held a cap in the socket, and a second pressing piston fitted in a slidable yet sealed manner in a deeply inner part of the socket and engaging at the lower part thereof with the upper ends of the tooth edges, a high-pressure air chamber being formed between the cap holding cylinder and the second pressing piston and communicating with the lower end of the third air passage, the second pressing piston being forced downward against the tooth edges when high-pressure air is supplied through the first, second, and third air passages into the high-pressure air chamber thereby to spread open the tooth edges and release the cap which has been held thereby, low-pressure air being supplied with adjustable pressure through the fourth air passage into the low-pressure air chamber thereby to adjustably set the maximum clutch slipping torque.

4. A screw-capping device according to claim 1, 2, or or 3 in which each of the cap holding pawls has a proximal part which is pivotally supported on the cap holding cylinder and a distal part at which the tooth edge is formed.

5. A screw-capping device according to claim 1, 2, or 3 in which each of the cap holding pawls has the shape of a circular cylinder which has been so cut away on one side thereof as to have a cross section with a concavely arcuate cutout, and one of the edges thus resulting at the cut-away part is formed to form the tooth edge.

* * * * *